US009702551B2

(12) United States Patent
Cadima

(10) Patent No.: US 9,702,551 B2
(45) Date of Patent: Jul. 11, 2017

(54) GAS BURNER

(71) Applicant: General Electric Company, Schenectady, NY (US)

(72) Inventor: Paul Bryan Cadima, Prospect, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 272 days.

(21) Appl. No.: 14/736,501

(22) Filed: Jun. 11, 2015

(65) Prior Publication Data

US 2016/0363327 A1 Dec. 15, 2016

(51) Int. Cl.

| | |
|---|---|
| ***F24C 3/00*** | (2006.01) |
| ***F23D 14/84*** | (2006.01) |
| ***F23D 14/06*** | (2006.01) |
| ***F24C 3/08*** | (2006.01) |
| ***F23D 14/26*** | (2006.01) |

(52) U.S. Cl.

CPC ..... *F23D 14/84* (2013.01); *F23D 14/06* (2013.01); *F23D 14/26* (2013.01); *F24C 3/085* (2013.01); *F23D 2207/00* (2013.01); *F23D 2900/14062* (2013.01)

(58) Field of Classification Search

CPC .. F24C 3/00; F23D 14/06; F23D 14/62; A47J 3/00

USPC ..... 126/39 E, 39 R, 25 R; 431/354, 284

See application file for complete search history.

(56) References Cited

U.S. PATENT DOCUMENTS

| | | | | |
|---|---|---|---|---|
| 6,082,994 | A | 7/2000 | Grandveau et al. | |
| 6,325,593 | B1 * | 12/2001 | Darkins, Jr. | F01D 5/186 415/115 |
| 8,535,052 | B2 * | 9/2013 | Cadima | F23D 14/06 126/214 R |
| 8,757,137 | B2 * | 6/2014 | Cadima | F23D 14/06 126/39 E |
| 8,845,326 | B2 * | 9/2014 | Shaffer | F23D 14/06 126/39 E |
| 8,973,569 | B2 | 3/2015 | Padgett et al. | |
| 9,134,034 | B2 * | 9/2015 | Han | F24C 3/087 |
| 9,175,859 | B2 * | 11/2015 | Han | F24C 15/002 |
| 9,217,572 | B2 * | 12/2015 | Park | F24C 3/085 |
| 9,255,710 | B2 * | 2/2016 | Cadima | F23D 14/06 |
| 2009/0165777 | A1 * | 7/2009 | Cadima | F23D 14/06 126/39 E |
| 2016/0363325 | A1 * | 12/2016 | Cadima | F24C 3/08 |
| 2016/0363326 | A1 * | 12/2016 | Cadima | F24C 3/08 |

* cited by examiner

*Primary Examiner* — Gregory Huson
*Assistant Examiner* — Nikhil Mashruwala
(74) *Attorney, Agent, or Firm* — Dority & Manning, P.A.

(57) ABSTRACT

A gas burner includes a burner base, a burner head and a cap. The cap is positioned on the burner head such that the burner head and the cap define a plurality of secondary air channels between the burner head and the cap. The plurality of secondary air channels is positioned above a plurality of flame ports.

18 Claims, 11 Drawing Sheets

GAS BURNER

FIELD OF THE INVENTION

The present subject matter relates generally to gas burner assemblies for appliances, such as gas range appliances or gas cooktop appliances.

BACKGROUND OF THE INVENTION

Certain cooktop appliances include gas burners for heating cooking utensils on the cooktop appliances. The gas burners may operate at a variety of flow rates in order to vary a heat output of the gas burners. The heat output of the gas burners is generally low at low flow rates and high at high flow rates. However, operating at high flow rates can be problematic. In particular, flames of the gas burners tend to lift at high flow rates. Various solutions have been proposed to alleviate or reduce flame lift at high flow rates.

For example, certain gas burners include burner heads with ledges above main flame ports of the gas burners. The ledges reduce a vertical velocity component of fuel flowing by the ledges in order to increase localized mixing and reduce flame lift at high flow rates. However, the ledges are generally cast as part of the burner head, and the flames can significantly heat the burner heat during operation of the gas burner. Thus, the burner head is generally cast from a material that is robust to high temperatures, and such materials are generally expensive and can comprise a significant portion of an overall cost of the gas burner.

As another example, certain gas burners include small retention ports in addition to larger main ports. The retention ports are generally positioned above main ports of the gas burner, and fuel from the small retention ports can stabilize flames at the larger main ports in order to reduce flame lift at high flow rates. However, effects of the retention ports are generally limited to a top portion of flames of the main ports, and lifting at a bottom portion of the flames is still problematic. Other gas burners include retention ports drilled into a burner body below the main ports. However, such retention ports are expensive to machine and clog easily with debris from cooking utensils above the gas burners. In addition, fuel from such retention ports also limits entrainment of secondary air for flames at the main ports, and lack of secondary air can cause poor combustion and flame coalescence at the main ports.

Accordingly, a gas burner with features for limiting flame lifting when a flow rate of gaseous fuel through the gas burner is high would be useful. In particular, a gas burner with features for limiting flame lifting while the gas burner is operating at a high flow rate without restricting a flow of secondary air to the flames would be useful.

BRIEF DESCRIPTION OF THE INVENTION

The present subject matter provides a gas burner. The gas burner includes a burner base, a burner head and a cap. The cap is positioned on the burner head such that the burner head and the cap define a plurality of secondary air channels between the burner head and the cap. The plurality of secondary air channels is positioned above a plurality of flame ports. Additional aspects and advantages of the invention will be set forth in part in the following description, or may be apparent from the description, or may be learned through practice of the invention.

In a first exemplary embodiment, a multi-ring gas burner is provided. The multi-ring gas burner includes an inner burner. An outer burner ring extends around the inner burner. The outer burner ring includes a burner base, a burner head and a cap. The burner head is positioned on the burner base such that the burner base and the burner head define a fuel chamber of the outer burner ring between the burner base and the burner head. A plurality of flame ports is formed on the burner head. The plurality of flame ports extend from the fuel chamber of the outer burner ring to an outer portion of the outer burner ring. The cap is positioned on the burner head such that the burner head and the cap define a plurality of secondary air channels between the burner head and the cap. An exit of each secondary air channel of the plurality of secondary air channels positioned proximate the outer portion of the outer burner ring.

In a second exemplary embodiment, a gas burner is provided. The gas burner includes a burner base. An annular burner head is positioned on the burner base such that the burner base and the burner head define a fuel chamber. A plurality of flame ports is formed on the burner head. The plurality of flame ports is configured for direction gaseous fuel out the fuel chamber. An annular cap is positioned on the burner head such that the burner head and the cap define a plurality of secondary air channels between the burner head and the cap. The plurality of secondary air channels is positioned above the plurality of flame ports. An exit of each secondary air channel of the plurality of secondary air channels is positioned proximate a respective flame port of the plurality of flame ports.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
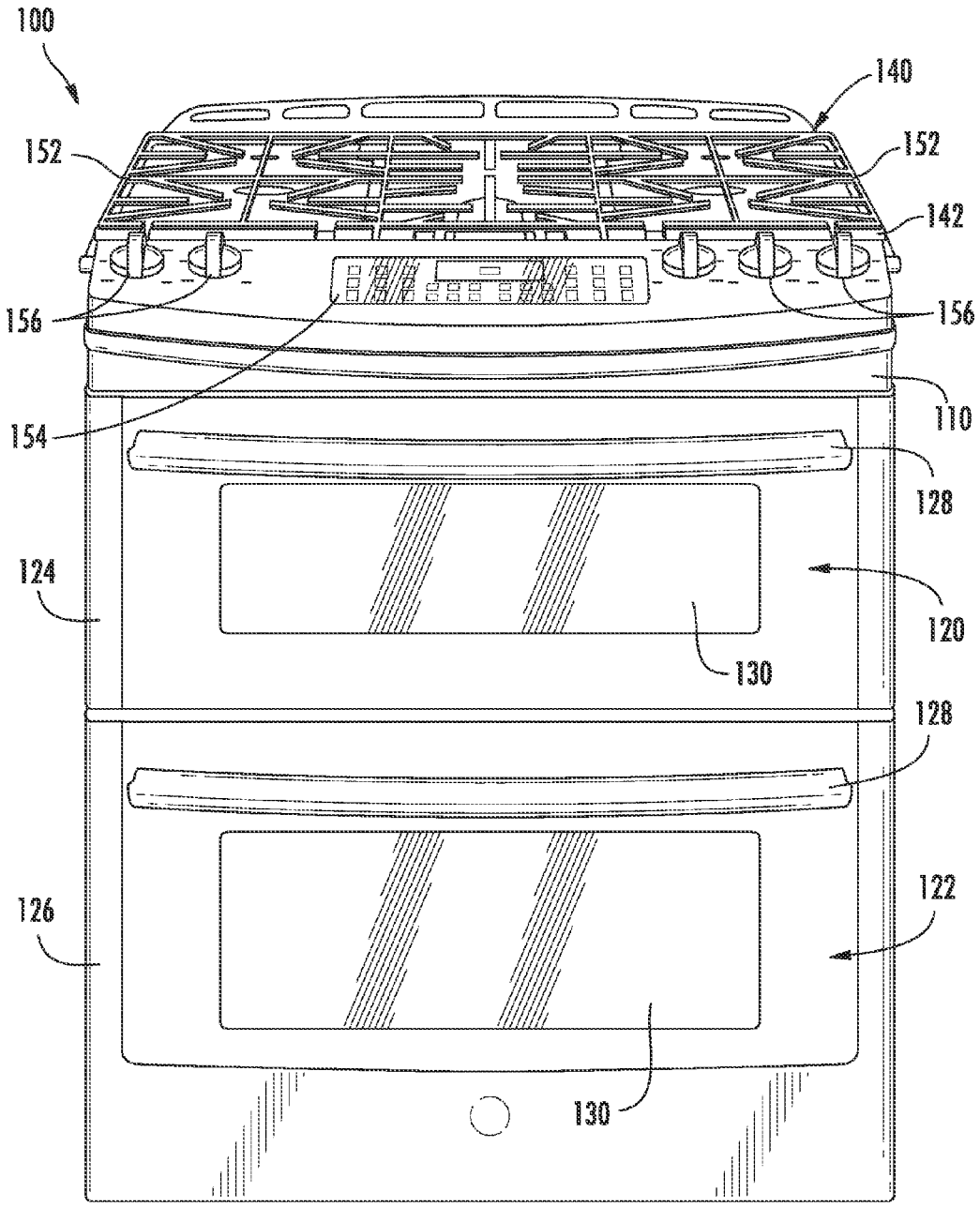
FIG. 1 provides a front, perspective view of a range appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
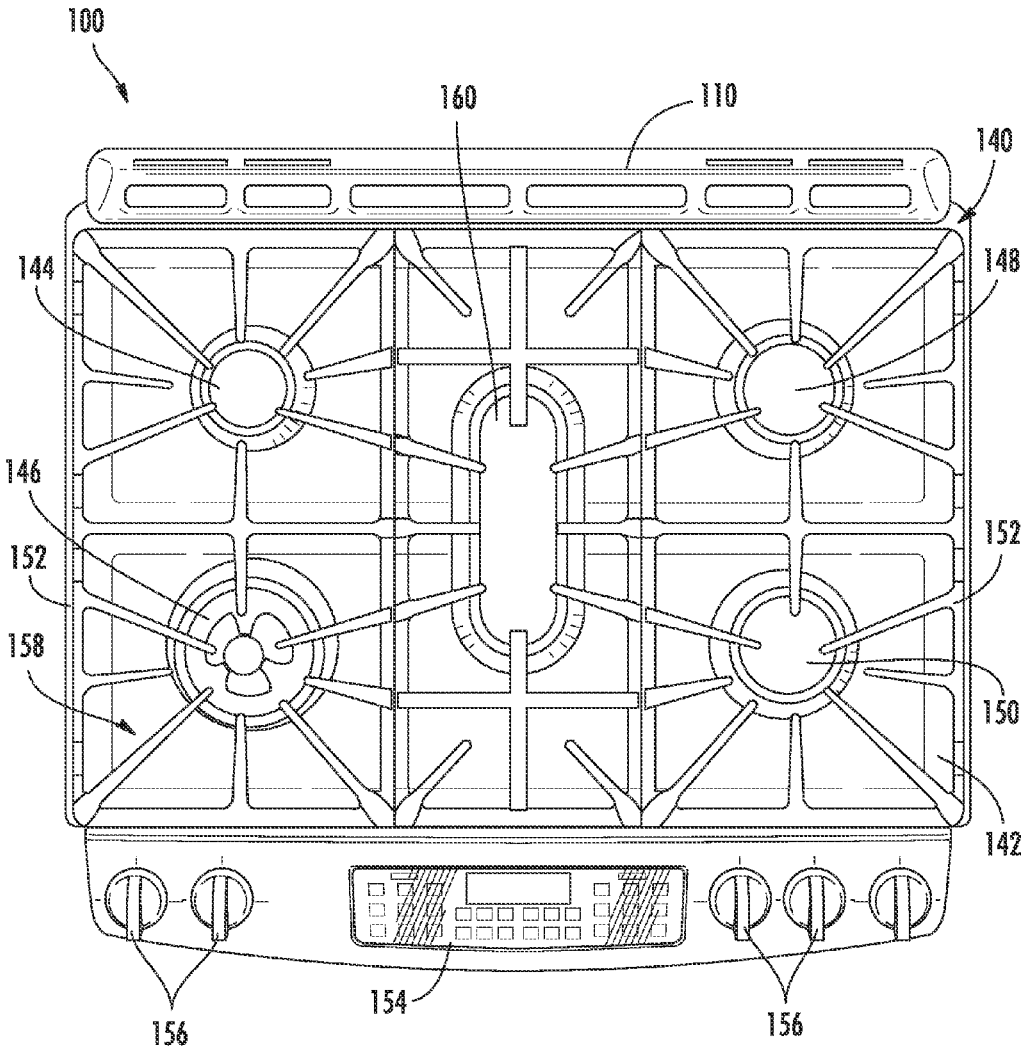
FIG. 2 provides a top, plan view of the exemplary range appliance of FIG. 1.

FIG. 1 provides a front, perspective view of a range appliance 100 as may be employed with the present subject matter. FIG. 2 provides a top, plan view of range appliance 100. Range appliance 100 includes an insulated cabinet 110. Cabinet 110 defines an upper cooking chamber 120 and a lower cooking chamber 122. Thus, range appliance 100 is generally referred to as a double oven range appliance. As will be understood by those skilled in the art, range appliance 100 is provided by way of example only, and the present subject matter may be used in any suitable appliance, e.g., a single oven range appliance or a standalone cooktop appliance. Thus, the exemplary embodiment shown in FIG. 1 is not intended to limit the present subject matter to any particular cooking chamber configuration or arrangement.

Upper and lower cooking chambers 120 and 122 are configured for the receipt of one or more food items to be cooked. Range appliance 100 includes an upper door 124 and a lower door 126 rotatably attached to cabinet 110 in order to permit selective access to upper cooking chamber 120 and lower cooking chamber 122, respectively. Handles 128 are mounted to upper and lower doors 124 and 126 to assist a user with opening and closing doors 124 and 126 in order to access cooking chambers 120 and 122. As an example, a user can pull on handle 128 mounted to upper door 124 to open or close upper door 124 and access upper cooking chamber 120. Glass window panes 130 provide for viewing the contents of upper and lower cooking chambers 120 and 122 when doors 124 and 126 are closed and also assist with insulating upper and lower cooking chambers 120 and 122. Heating elements (not shown), such as electric resistance heating elements, gas burners, microwave heating elements, halogen heating elements, or suitable combinations thereof, are positioned within upper cooking chamber 120 and lower cooking chamber 122 for heating upper cooking chamber 120 and lower cooking chamber 122.

Range appliance 100 also includes a cooktop 140. Cooktop 140 is positioned at or adjacent a top portion of cabinet 110. Thus, cooktop 140 is positioned above upper and lower cooking chambers 120 and 122. Cooktop 140 includes a top panel 142. By way of example, top panel 142 may be constructed of glass, ceramics, enameled steel, and combinations thereof.

For range appliance 100, a utensil holding food and/or cooking liquids (e.g., oil, water, etc.) may be placed onto grates 152 at a location of any of burner assemblies 144, 146, 148, 150. Burner assemblies 144, 146, 148, 150 provide thermal energy to cooking utensils on grates 152. As shown in FIG. 1, burners assemblies 144, 146, 148, 150 can be configured in various sizes so as to provide e.g., for the receipt of cooking utensils (i.e., pots, pans, etc.) of various sizes and configurations and to provide different heat inputs for such cooking utensils. Grates 152 are supported on a top surface 158 of top panel 142. Range appliance 100 also includes a griddle burner 160 positioned at a middle portion of top panel 142, as may be seen in FIG. 2. A griddle may be positioned on grates 152 and heated with griddle burner 160.

A user interface panel 154 is located within convenient reach of a user of the range appliance 100. For this exemplary embodiment, user interface panel 154 includes knobs 156 that are each associated with one of burner assemblies 144, 146, 148, 150 and griddle burner 160. Knobs 156 allow the user to activate each burner assembly and determine the amount of heat input provided by each burner assembly 144, 146, 148, 150 and griddle burner 160 to a cooking utensil located thereon. User interface panel 154 may also be provided with one or more graphical display devices that deliver certain information to the user such as e.g., whether a particular burner assembly is activated and/or the rate at which the burner assembly is set.

Although shown with knobs 156, it should be understood that knobs 156 and the configuration of range appliance 100 shown in FIG. 1 is provided by way of example only. More specifically, user interface panel 154 may include various input components, such as one or more of a variety of touch-type controls, electrical, mechanical or electro-mechanical input devices including rotary dials, push buttons, and touch pads. The user interface panel 154 may include other display components, such as a digital or analog display device designed to provide operational feedback to a user.

Figure 3:
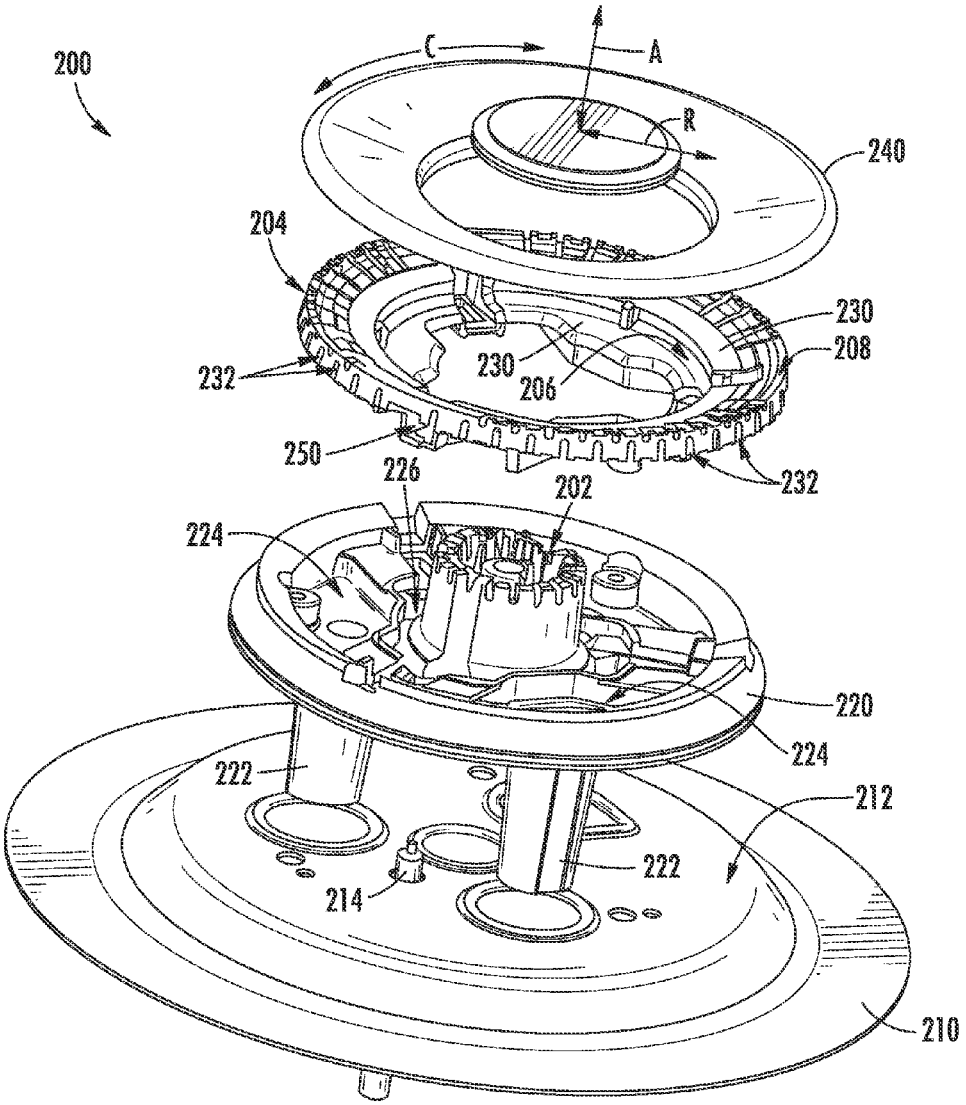
FIG. 3 provides a top, exploded view of a burner assembly according to an exemplary embodiment of the present subject matter.
Figure 4:
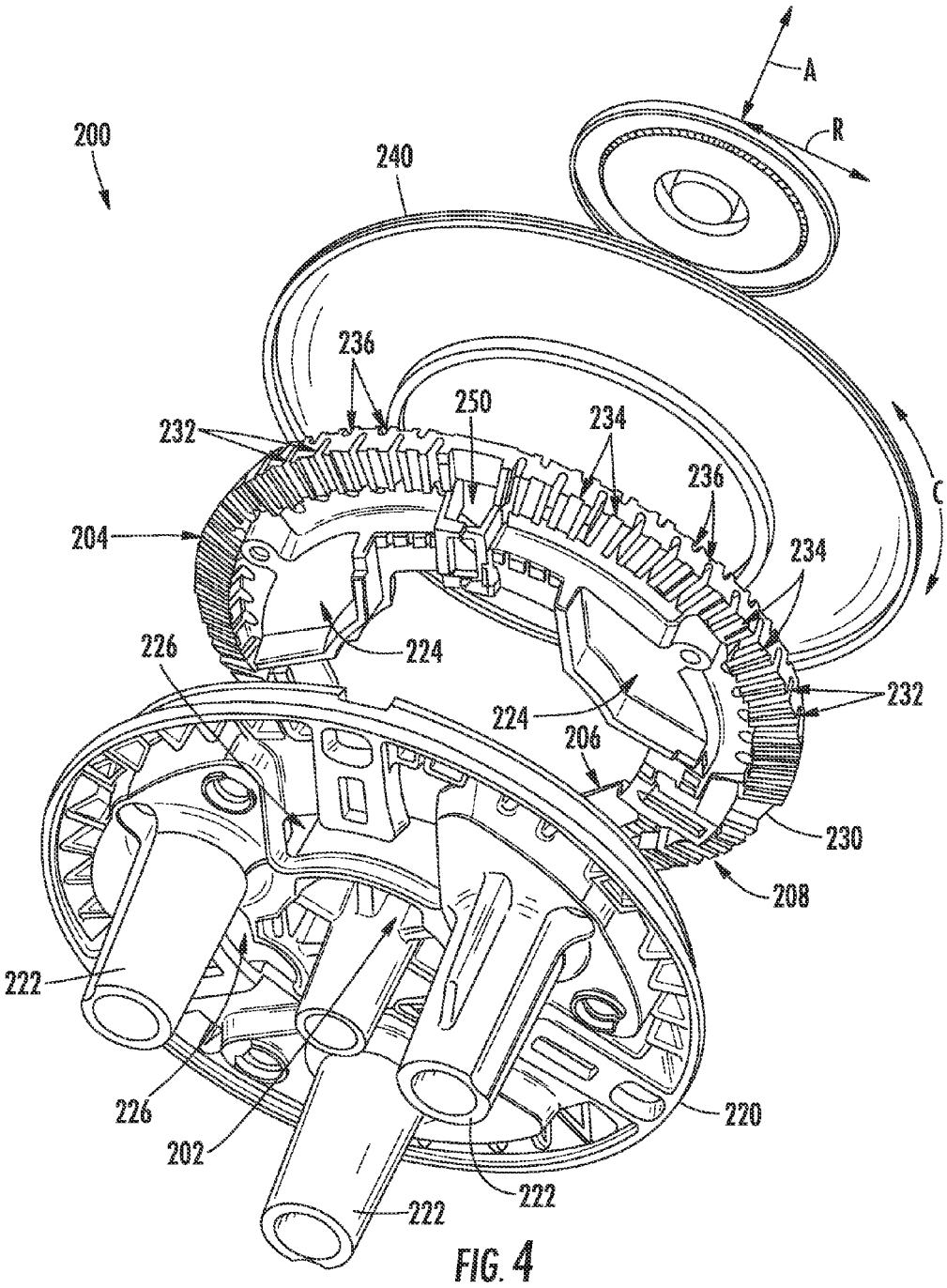
FIG. 4 provides a bottom, exploded view of the exemplary burner assembly of FIG. 3.

FIG. 3 provides a top, exploded view of a burner assembly 200 according to an exemplary embodiment of the present subject matter. FIG. 4 provides a bottom, exploded view of burner assembly 200. Burner assembly 200 may be used in or with any suitable appliance. For example, burner assembly 200 may be used in range appliance 100 (FIG. 2) as one of burner assemblies 144, 146, 148, 150. As may be seen in FIG. 3, burner assembly 200 includes an inner burner 202 and an outer burner ring 204 that extends around inner burner 202. Thus, burner assembly 200 is commonly referred to as a "multi-ring gas burner." As discussed in greater detail below, burner assembly 200 includes features for assisting with retaining flames at flame ports 232 of burner assembly 200, e.g., when burner assembly 200 is operating at high flow rates. Burner assembly 200 defines an axial direction A, a radial direction R and a circumferential direction C.

As may be seen in FIGS. 3 and 4, burner assembly 200 includes a burner base 220, a burner head 230 and a top cap 240. When assembled together, burner base 220, burner head 230 and cap 240 may be positioned on a panel 210, such as top panel 142 of cooktop 140, to form burner assembly 200. In particular, burner base 220 may be positioned on a top surface 212 of panel 210. Inner burner 202 may be formed on or with burner base 220, as shown in FIG. 3, and burner head 230 may be positioned on burner base 220 such that burner head 230 and burner base 220 form outer burner ring 204 with cap 240 positioned on burner head 230.

Outer burner ring 204 extends between an inner portion 206 and an outer portion 208, e.g., along the radial direction R. Thus, inner portion 206 of outer burner ring 204 may be spaced apart from outer portion 208 of outer burner ring 204, e.g., along the radial direction R. Inner portion 206 of outer burner ring 204 may be positioned adjacent inner burner 202.

Outer burner ring 204 defines at least one fuel chamber 224. In particular, burner head 230 may be positioned on burner base 220 such that burner base 220 and burner head 230 define fuel chamber 224 between burner base 220 and burner head 230. Fuel chamber 224 is configured for receiving gaseous fuel. For example, a mounting bracket 216 mounted to panel 210 below panel 210 may support gas line conduits that each have an orifice for directing gaseous fuel out of the gas line conduits. Venturi inlets 222 may be positioned for receiving the gaseous fuel and drawing in ambient air from below panel 210, as will be understood by those skilled in the art. Within the Venturi inlets 222 and fuel chamber 224, the gaseous fuel and ambient air mix to form a suitable fluid for combustion by burner assembly 200.

Figure 7:
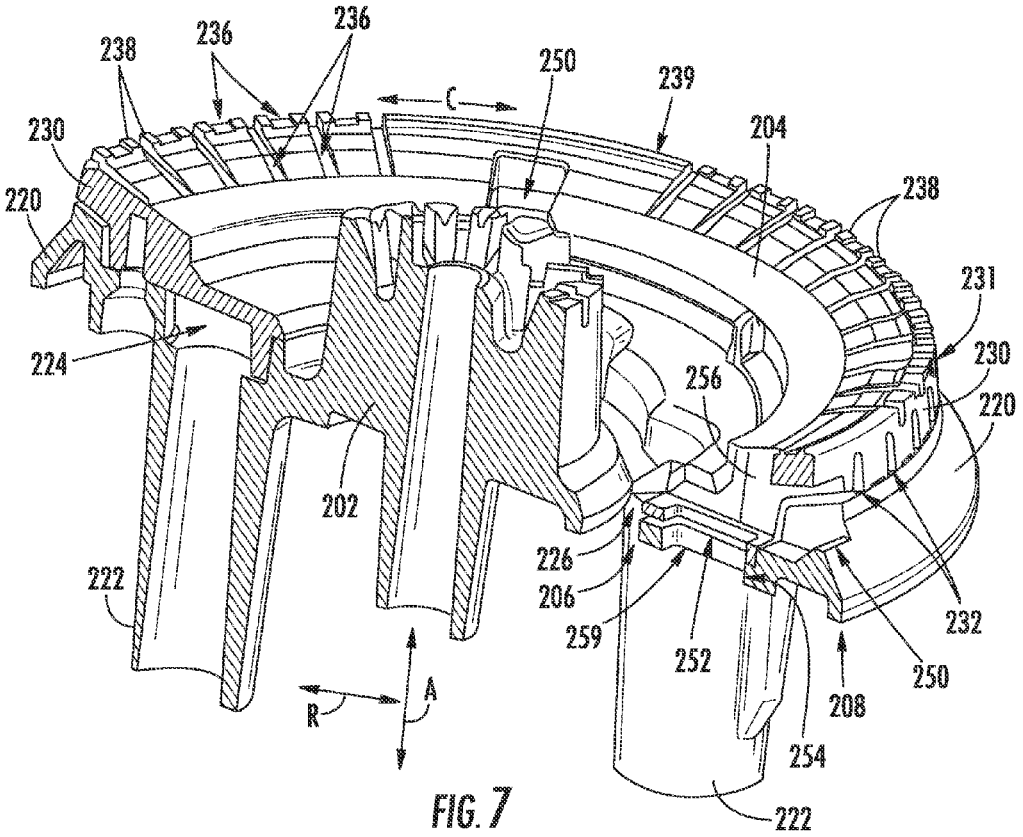
FIG. 7 provides a section view of a burner base and a burner head of the exemplary burner assembly of FIG. 3.
Figure 8:
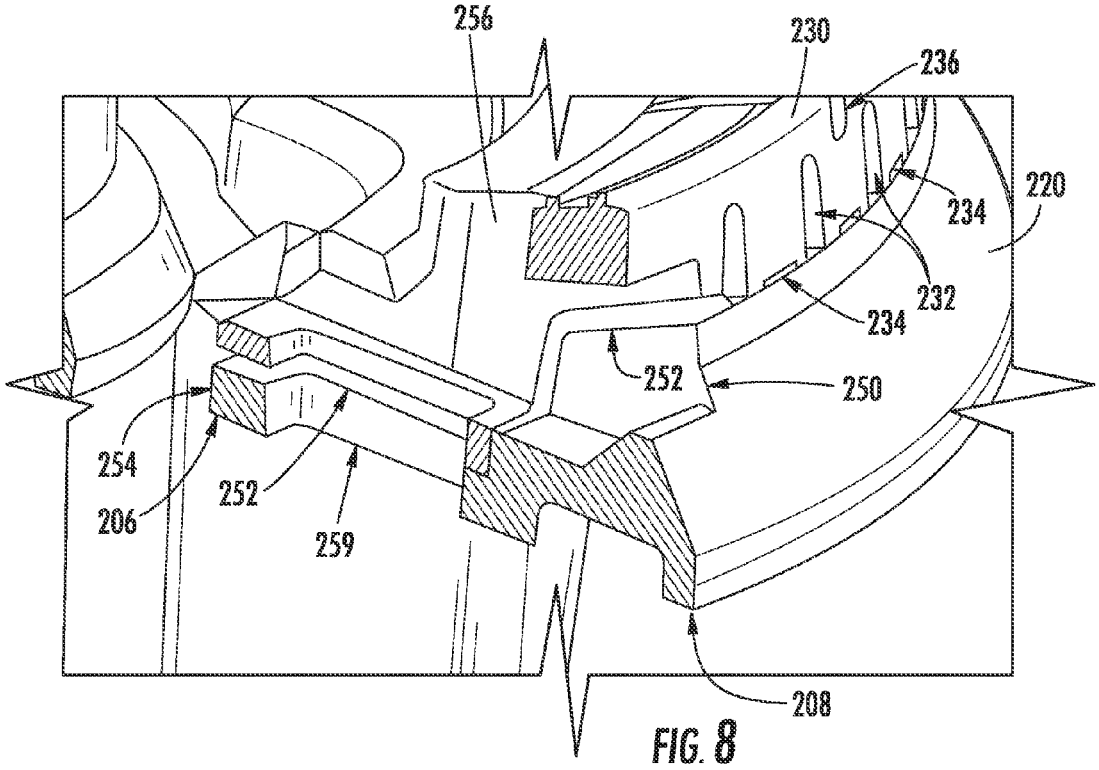
FIG. 8 provides another section view of the burner base and the burner head of the exemplary burner assembly of FIG. 3 and the cross-lighting duct of the exemplary burner assembly.

Outer burner ring 204 also defines a plurality of flame ports 232, e.g., at outer portion 208 of outer burner ring 204. In particular, burner head 230 and/or burner base 220 may define flame ports 232 at outer portion 208 of outer burner ring 204. For example, burner head 230 may define a top portion of flame ports 232 and burner base 220 may define a bottom portion of flame ports 232 such that burner head 230 and burner base 220 form flame ports 232 when burner head 230 is positioned on burner base 220, as shown in FIGS. 7 and 8. Turning back to FIGS. 3 and 4, flame ports 232 extend, e.g., along the radial direction R, from fuel chamber 224 to outer portion 208 of outer burner ring 204. For example, an entrance of each flame port of flame ports 232 may be positioned at fuel chamber 224, and an exit 233 (FIG. 10) of each flame port of flame ports 232 may be positioned at outer portion 208 of outer burner ring 204. Flame ports 232 are configured for directing gaseous fuel from fuel chamber 224 out of outer burner ring 204. At exits 233 of flame ports 232, the gaseous fuel from fuel chamber 224 may be combusted, e.g., to heat a cooking utensil above burner assembly 200. Flame ports 232 may be spaced apart from each other or distributed, e.g., along the circumferential direction C, at outer portion 208 of outer burner ring 204.

Cap 240 is positioned on burner head 230, e.g., over flame ports 232. Thus, burner head 230 may be positioned between burner base 220 and cap 240, e.g., along the axial direction A. As may be seen in FIGS. 3 and 4, burner head 230 and/or cap 240 may have an annular cross-sectional shape, e.g., in a plane that is perpendicular to the axial direction A. Thus, inner burner 202 may be disposed within a central portion of burner head 230 and/or cap 240.

Components of burner assembly 200 may be formed of or within any suitable material. For example, burner base 220 may be formed of cast or forged metal, such as aluminum alloy, iron, brass, etc. Similarly, burner head 230 may be formed of forged or cast metal, such as aluminum alloy, iron, brass, etc. Thus, burner base 220 and burner head 230 may be formed of or within similar or common materials, e.g., such that burner base 220 and burner head 230 expand in a similar manner during heating. As another example, cap 240 may be formed of or with a stamped metal, such as stamped steel. Thus, cap 240 may be formed of or with a dissimilar material relative to burner base 220 and burner head 230.

Burner assembly 200 also includes an igniter 214. Igniter 214 is positioned proximate inner burner 202. Igniter 214 is configured for selectively producing a spark or other suitable ignition source. Thus, igniter 214 may selectively ignite gaseous fuel at inner burner 202. As discussed in greater detail below in the context of FIGS. 5-8, burner assembly 200 also include features for assisting with transferring flames from inner burner 202 to outer burner ring 204, e.g., after igniter 214 ignites gaseous fuel at inner burner 202.

Figure 5:
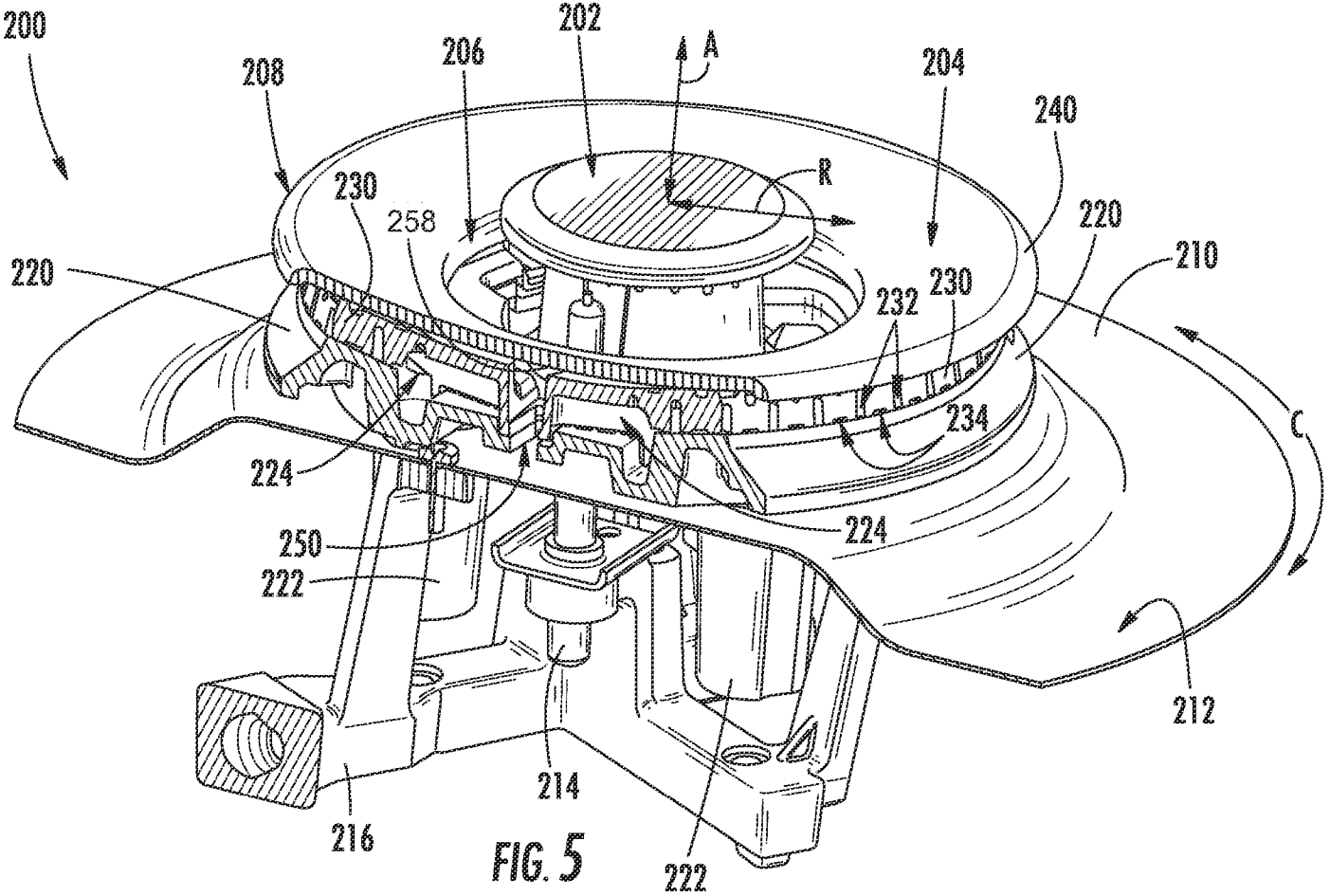
FIG. 5 provides a partial section view of the exemplary burner assembly of FIG. 3.
Figure 6:
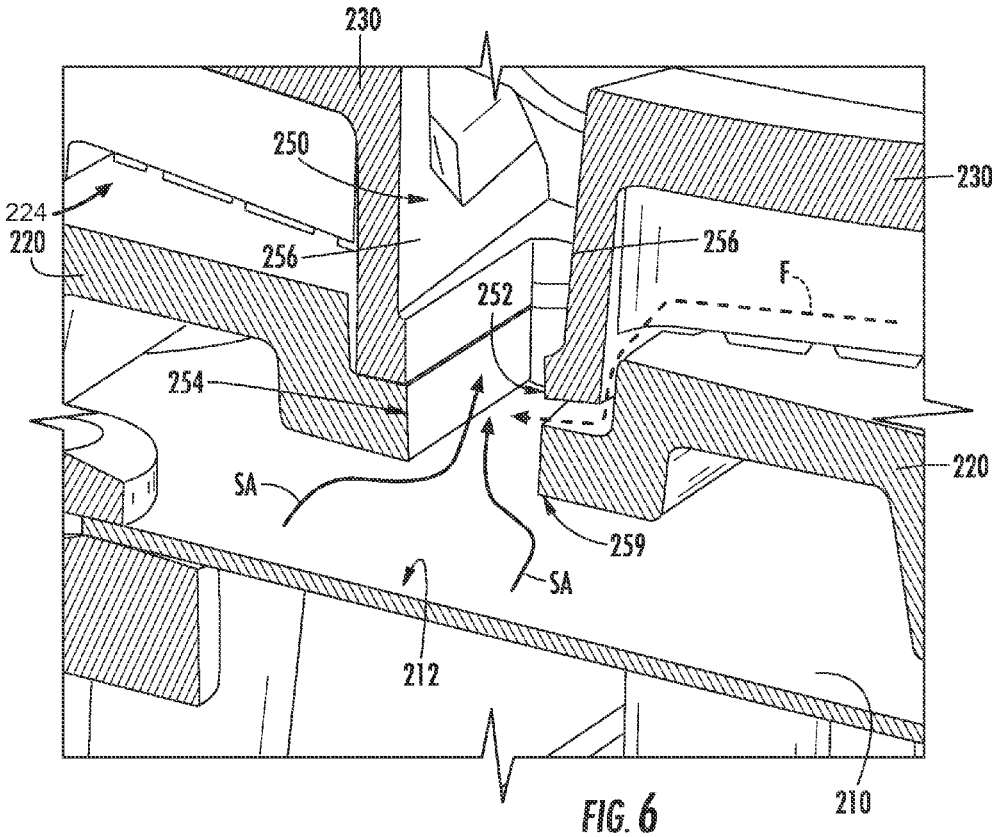
FIG. 6 provides another partial section view of the exemplary burner assembly of FIG. 3 and a cross-lighting duct of the exemplary burner assembly.

FIG. 5 provides a partial section view of burner assembly 200. FIG. 6 provides another partial section view of burner assembly 200 and a cross-lighting duct 250 of burner assembly 200. FIG. 7 provides a section view of burner base 220 and burner head 230 of burner assembly 200. FIG. 8 provides another section view of burner base 220 and burner head 230 of burner assembly 200 and the cross-lighting duct 250 of burner assembly 200. Cross-lighting duct 250 of burner assembly 200 is configured for assisting with transferring flames from inner burner 202 to outer burner ring 204, as discussed in greater detail below.

As may be seen in FIG. 7, cross-lighting duct 250 extends from inner portion 206 of outer burner ring 204 to outer portion 208 of outer burner ring 204, e.g., along the radial direction R. Outer burner ring 204 also defines a fuel delivery aperture 252. Fuel delivery aperture 252 is positioned at or adjacent a bottom portion 254 of cross-lighting duct 250, as shown in FIGS. 6 and 8. In various exemplary embodiments, the bottom portion 254 of cross-lighting duct 250 may correspond to the bottom half of cross-lighting duct 250, the bottom third of cross-lighting duct 250, the bottom quarter of cross-lighting duct 250 or the bottom eighth of cross-lighting duct 250. Fuel delivery aperture 252 may also be positioned below flame ports 232, e.g., along the axial direction A. Fuel delivery aperture 252 extends from fuel chamber 224 to cross-lighting duct 250. Thus, fuel delivery aperture 252 directs gaseous fuel (shown with arrow F in FIG. 6) from fuel chamber 224 into cross-lighting duct 250 during operation of burner assembly 200.

As may be seen in FIGS. 6 and 8, fuel delivery aperture 252 may be formed by burner head 230 and burner base 220. For example, burner head 230 may be positioned on burner base 220 such that fuel delivery aperture 252 is defined (e.g., by a gap or space) between burner head 230 and burner base 220. In particular, as shown in FIG. 8, fuel delivery aperture 252 may be at least one slot defined between burner head 230 and burner base 220 at bottom portion 254 of cross-lighting duct 250, e.g., with the slot extending between inner portion 206 of outer burner ring 204 and outer portion 208 of outer burner ring 204 along the radial direction R. As another example, fuel delivery aperture 252 may be a plurality of apertures defined between burner head 230 and burner base 220 at bottom portion 254 of cross-lighting duct 250, e.g., with the plurality of apertures distributed between inner portion 206 of outer burner ring 204 and outer portion 208 of outer burner ring 204 along the radial direction R.

Burner head 230 may be positioned on burner base 220 such that side walls 256 of cross-lighting duct 250 are formed by burner head 230 and a top wall 258 of cross-lighting duct 250 is formed by cap 240. Thus, side walls 256 of cross-lighting duct 250 may be formed of or with burner head 230, and top wall 258 of cross-lighting duct 250 may be formed of or with cap 240. In addition, burner head 230 and burner base 220 may define a secondary air opening 259 at bottom portion 254 of cross-lighting duct 250. In such a manner, at least a portion of the bottom of cross-lighting duct 250 may be open, e.g., such that air from below panel 210 and/or burner assembly 200 (shown with arrows SA in FIG. 6) may flow into cross-lighting duct 250 via secondary air opening 259. Fuel delivery aperture 252 may be positioned at or proximate secondary air opening 259 at bottom portion 254 of cross-lighting duct 250. In particular, fuel delivery aperture 252 may be positioned above secondary air opening 259, e.g., along the axial direction A, at bottom portion 254 of cross-lighting duct 250. In such a manner, air may flow to and be entrained by fuel exiting fuel delivery aperture 252 within cross-lighting duct 250 via secondary air opening 259. As discussed above, cross-lighting duct 250 of burner assembly 200 is configured for assisting with transferring flames from inner burner 202 to outer burner ring 204.

In particular, gaseous fuel at inner burner 202 may be ignited by igniter 212, and flames at inner burner 202 and/or igniter 214 may ignite gaseous fuel exiting fuel chamber 224 at fuel delivery aperture 252 proximate inner portion 206 of outer burner ring 204. The flame may be carried along fuel delivery aperture 252 within cross-lighting duct 250 from inner portion 206 of outer burner ring 204 to outer portion 208 of outer burner ring 204, e.g., along the radial direction R. At outer portion 208 of outer burner ring 204, the flame on fuel delivery aperture 252 may ignite gas exiting flame ports 232. In such a manner, cross-lighting duct 250 may carry flames from inner burner 202 to outer burner ring 204 in order to assist with lighting gaseous fuel at flame ports 232.

The arrangement of cross-lighting duct 250 and fuel delivery aperture 252 within cross-lighting duct 250 may assist with reliably transferring flames from inner burner 202 to outer burner ring 204 for a wide variety of gaseous fuel flow rates through burner assembly 200. For example, positioning fuel delivery aperture 252 at or adjacent bottom portion 254 of cross-lighting duct 250 (e.g., and away from top wall 258 of cross-lighting duct 250 along the axial direction A) allows flames at fuel delivery aperture 252 to burn upwardly, as flames naturally prefer. As another example, momentum of gaseous fuel being injected into cross-lighting duct 250 at fuel delivery aperture 252 may assist with drawing required air into cross-lighting duct 250. In particular, at low flow rates, slow injection of gaseous fuel into cross-lighting duct 250 at fuel delivery aperture 252 only draws a low volume of secondary air into cross-lighting duct 250, and fast injection of gaseous fuel into cross-lighting duct 250 at fuel delivery aperture 252 draws a larger volume of secondary air into cross-lighting duct 250. Thus, a self-correcting or self-regulating fuel/air mixture results within cross-lighting duct 250 and provides a robust flame transfer mechanism for both high and low fuel flow rates. As yet another example, positioning fuel delivery aperture 252 at or adjacent bottom portion 254 of cross-lighting duct 250 limits quenching of flames at fuel delivery aperture 252, e.g., by top wall 258 of cross-lighting duct 250, since there is vertical room for the flames to propagate. Thus, flames at fuel delivery aperture 252 may be smaller in size compared to ducts with apertures at a top portion of a duct due to thermal loss differences between the designs. Further, flames at fuel delivery aperture 252 may burn clean and fast.

Figure 9:
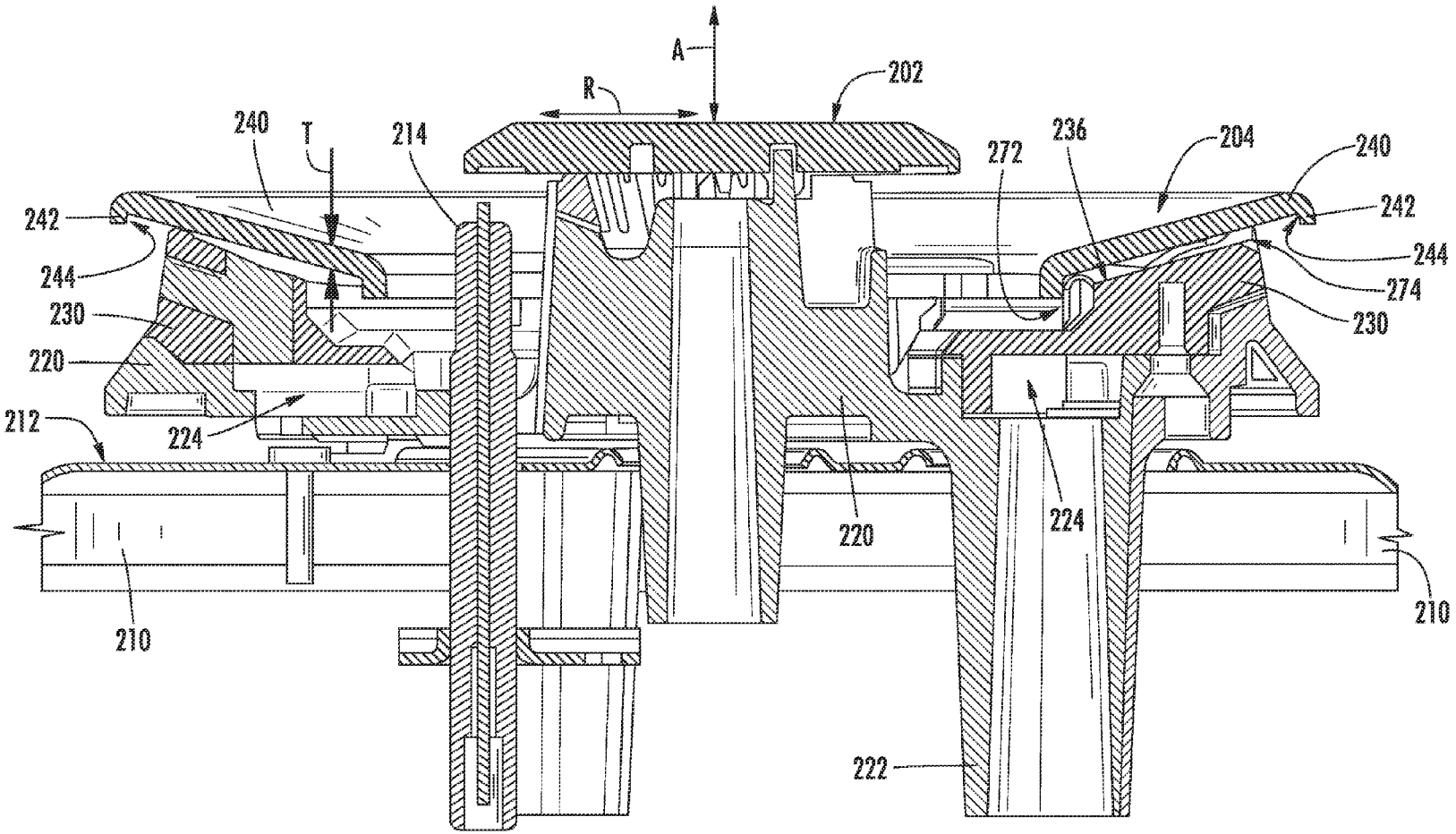
FIG. 9 provides a section view of the exemplary burner assembly of FIG. 3
Figure 10:
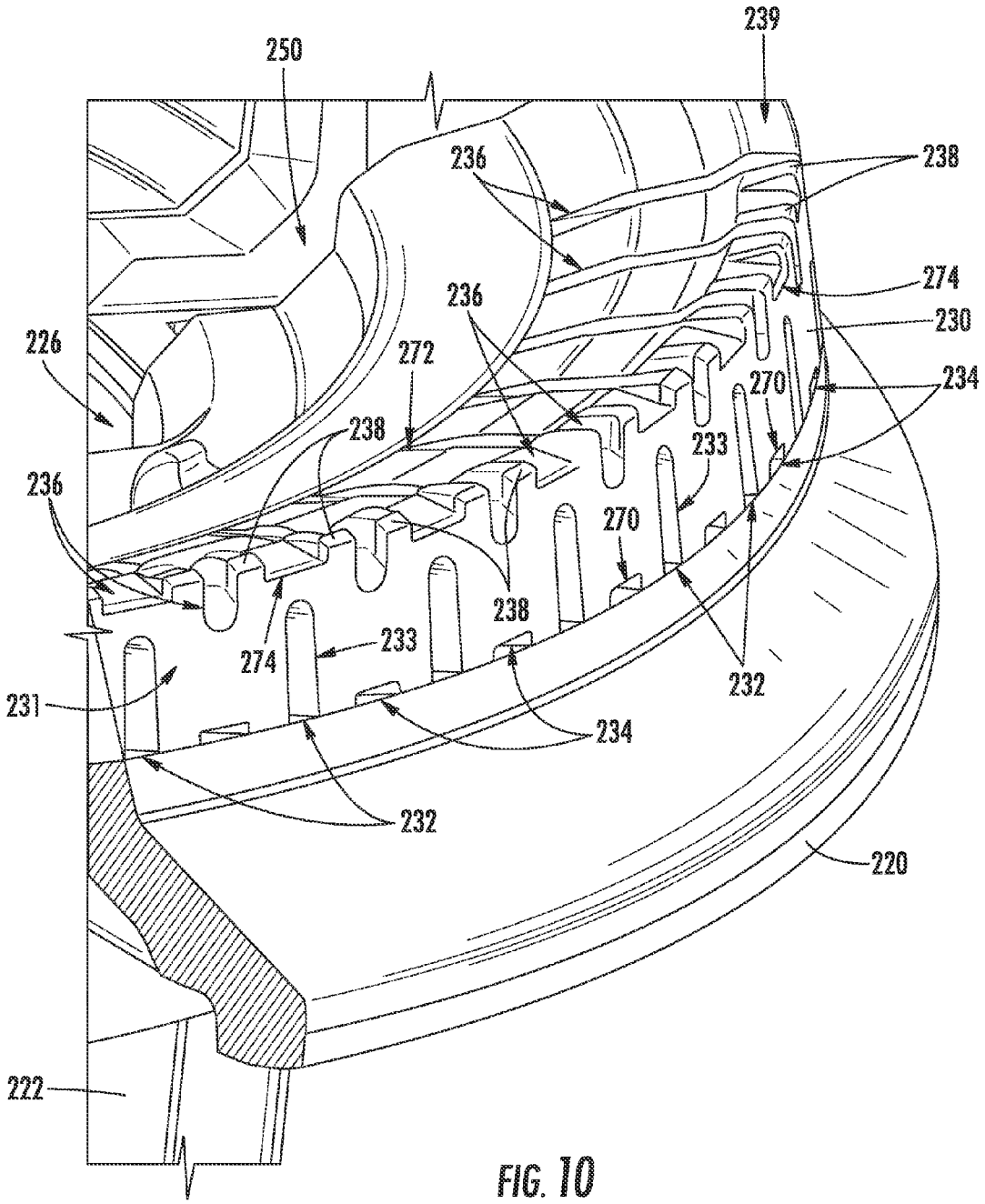
FIG. 10 provides a partial perspective view of the burner base and the burner head of the exemplary burner assembly of FIG. 3.
Figure 11:
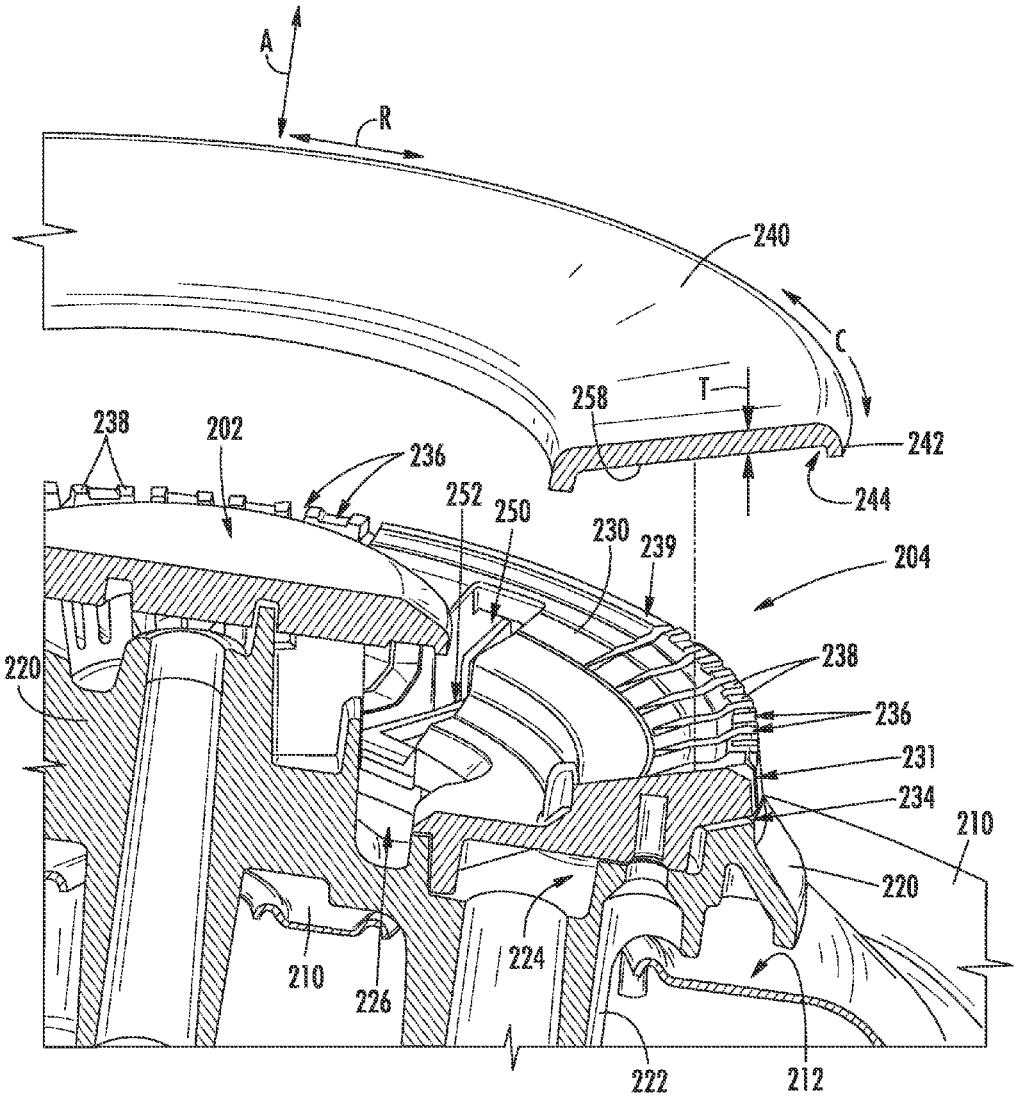
FIG. 11 provides a partially exploded, partial section view of the exemplary burner assembly of FIG. 3.

FIG. 9 provides a section view of burner assembly 200. FIG. 10 provides a partial perspective view of burner base 220 and burner head 230 of burner assembly 200. FIG. 11 provides a partially exploded, partial section view of burner assembly 200. As discussed in greater detail below in the context of FIGS. 9, 10 and 11, burner assembly 200 includes features for retaining flames at flame ports 232, e.g., when burner assembly 200 is operating at a high flow rate.

As may be seen in FIG. 9, cap 240 is positioned on burner head 230, e.g., such that cap 240 is positioned over burner head 230 along the axial direction A. Cap 240 has a ledge 242, and ledge 242 extends downwardly, e.g., along the axial direction A. Thus, ledge 242 may extend over flame ports 232, as shown in FIGS. 5 and 9. In particular, ledge 242 may have an inner surface 244 that faces towards flame ports 232 along the radial direction R. Inner surface 244 of ledge 242 may be positioned over flame ports 232, e.g., along the axial direction A. Due to placement of ledge 242 of cap 240 relative to flame ports 232, ledge 242 of cap 240 may assist with retaining flames at flame ports 232 and maintaining flame stability, e.g., by reducing lifting of flames along the axial direction A and/or radial direction R, as will be understood by those skilled in the art. For example, a velocity of gaseous fuel and air flowing from flame ports 232 may decrease when the gaseous fuel and air impact or engage ledge 242 of cap 240, establishing a flame anchor and thereby assisting with retaining flames at flame ports 232 and maintaining flame stability.

Flame ports 232 may be at least partially formed on an outer surface 231 of burner head 230, e.g., such that exits 233 of flame ports 232 are positioned at or on outer surface 231 of burner head 230. Outer surface 231 of burner head 230 faces inner surface 244 of ledge 242, e.g., along the radial direction R, and outer surface 231 of burner head 230 may be inclined such that outer surface 231 of burner head 230 is substantially parallel to inner surface 244 of ledge 242. As used herein the term "substantially parallel" means no more than ten degrees out of parallel. Outer surface 231 of burner head 230 may be inclined at any suitable angle. For example, outer surface 231 of burner head 230 may be inclined at an angle between five degrees and twenty degrees from vertical.

As may be seen in FIGS. 5 and 9, cap 240 is not exposed to and/or does not contact fuel chamber 224. Thus, cap 240 may not assist burner base 220 and/or burner head 230 with forming fuel chamber 224 between burner base 220 and burner head 230. As an example, burner head 230 may be positioned between cap 240 and fuel chamber 224, e.g., along the axial direction A. Due to such positioning and arrangement of cap 240, cap 240 may be heated by flames at flame ports 232, and heat transfer between cap 240 and burner head 230 may be limited or negligible. Thus, cap 240 provides ledge 242 that assists with stabilizing flames at flame ports 232 but does not define fuel chamber 224. In certain exemplary embodiments, cap 240 need not be constructed of a material or thickness suitable for maintaining strict tolerances during heating of cap 240 because cap 240 does not define fuel chamber 224. Accordingly, cap 240 may be constructed of a relatively thin material compared to exemplary embodiments where cap 240 assists with forming fuel chamber 224. As an example, cap 240 may be stamped from a sheet of metal having a thickness of no more than eighty-five thousandths of an inch. Thus, cap 240 may be have a thickness T, e.g., along the axial direction A, no more than eighty-five thousandths of an inch.

In contrast to cap 240, burner head 230 may not include a ledge that is positioned over flame ports 232, as shown in FIGS. 5 and 9, in certain exemplary embodiments. Thus, heat transfer from flames at flame ports 232 to burner head 230 may be less than if burner head 230 included a ledge positioned over flame ports 232. Such features of burner head 230 may assist with maintaining integrity of fuel chamber 224 during operation of burner assembly 200, e.g., due to the reduced operating temperatures resulting from such arrangement of burner head 230.

Turning to FIGS. 10 and 11, burner head 230 also includes a plurality of projections 238. Projections 238 may be positioned at a top portion 239 of burner head 230 and extend upwardly, e.g., along the axial direction A, from burner head 230. Cap 240 may be positioned on projections 238 such that cap 240 rests on projections 238 at top portion 239 of burner head 230. Thus, projections 238 may support cap 240 over other portions of burner head 230 such that cap 240 is spaced apart from the other portions of burner head 230, e.g., along the axial direction A.

Projections 238 may be spaced apart from one another or distributed, e.g., along the circumferential direction C, such that gaps or thermal breaks are provided between cap 240 and burner head 230 between adjacent projections of projections 238. The thermal breaks assist with limiting conductive heat transfer between cap 240 and burner head 230. Thus, as cap 240 is heated by flames at ledge 242 of cap 240, conductive heat transfer between cap 240 and burner head 230 may be limited by the thermal breaks.

Burner head 230 and cap 240 also define a plurality of secondary air passages of channels 236 between burner head 230 and cap 240. Channels 236 permit air to flow between burner head 230 and cap 240, e.g., along the radial direction R, from inner portion 206 of outer burner ring 204 to outer portion 208 of outer burner ring 204. Air within channels 236 may assist with cooling burner head 230 and/or cap 240. Testing of burner 200 with channels 236 between burner head 230 and cap 240 assisted with providing a temperature difference of ninety degrees Fahrenheit for the overall burner assembly 200 relative to a burner without channels between a burner head and a cap.

Channels 236 may be distributed in any suitable manner on burner assembly 200. For example, channels 236 may be spaced apart from each other or distributed, e.g., along the circumferential direction C. In particular, channels 236 may be disposed between flame ports 232, e.g., along the circumferential direction C, and/or above flame ports 232, e.g., along the axial direction A, as shown in FIG. 10. As may be seen in FIG. 11, channels 236 may not be positioned or formed over cross-lighting duct 250, in certain exemplary embodiments.

Flames at flame ports 232 may assist with drawing air through channels 236, as will be understood by those skilled in the art. In addition, air that exits channels 236, e.g., at or adjacent ledge 242 of cap 240, may assist with improving combustion of gaseous fuel at flame ports 232 and/or with preventing flame coalescence at flame ports 232. Thus, each channel of channels 236 may have an exit 274 positioned proximate outer portion 208 of outer burner ring 204 and/or ledge 242 of cap 240. In addition, each channel of channels 236 may have an entrance 272 positioned proximate inner portion 206 of outer burner ring 204. In particular, as seen in FIG. 11, burner base 220 (e.g., and burner body 230) define an opening 226, e.g., at inner portion 206 of outer burner ring 204, and opening 226 of burner base 220 may be positioned proximate entrance 272 of channels 236. Opening 226 may be configured for directing air from below panel 210 and/or burner base 220 through burner base 220 to channels 236. Thus, air from below panel 210 and/or burner base 220 may flow through opening 226 to channels 236, e.g., during operation of burner assembly 200. Turning back to FIG. 9, channels 236 may slope upwardly from inner portion 206 of outer burner ring 204 to outer portion 208 of outer burner ring 204.

Turning now to FIGS. 10 and 11, outer burner ring 204 also defines a plurality of retention ports 234, e.g., at outer portion 208 of outer burner ring 204. In particular, burner head 230 and/or burner base 220 may define retention ports 234 at outer portion 208 of outer burner ring 204. For example, burner head 230 may define a top portion of retention ports 234 and burner base 220 may define a bottom portion of retention ports 234 such that burner head 230 and burner base 220 form retention ports 234 when burner head 230 is positioned on burner base 220, as shown in FIGS. 10 and 11. Retention ports 234 extend, e.g., along the radial direction R, from fuel chamber 224 to outer portion 208 of outer burner ring 204. For example, an entrance of each retention port of retention ports 234 may be positioned at fuel chamber 224, and an exit 270 of each retention port of retention ports 234 may be positioned at outer portion 208 of outer burner ring 204. Retention ports 234 are configured for directing gaseous fuel from fuel chamber 224 out of outer burner ring 204. At exits 270 of retention ports 234, the gaseous fuel from fuel chamber 224 may be combusted, e.g., to assist with retaining flames at flame ports 232 when burner assembly 200 is operating at high flow rates.

Retention ports 234 may be distributed in any suitable manner at outer portion 208 of outer burner ring 204. For example, retention ports 234 may be spaced apart from each other or distributed, e.g., along the circumferential direction C, at outer portion 208 of outer burner ring 204. In particular, each retention port of retention ports 234 may be disposed between a respective pair of adjacent flame ports of flame ports 232, e.g., along the circumferential direction C. Retention ports 234 are also positioned at a bottom of flame ports 232 or below flame ports 232, e.g., along the axial direction A, as shown in FIG. 10. As may be seen in FIG. 10, retention ports 234 are smaller than flame ports 232, e.g., in order to meter fluid flow through retention ports 234 when burner assembly 200 is operating at high flow rates.

It should be understood that the flame retention features of burner assembly 200 discussed above may be used in or with any other suitable burner assembly. For example, retention ports 234 and channels 236 may be provided on a single ring burner assembly. Thus, e.g., burner assembly 200 need not include inner burner 202, in alternative exemplary embodiments.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A multi-ring gas burner, comprising:

an inner burner;

an outer burner ring extending around the inner burner, the outer burner ring including a burner base, a burner head and a cap, the burner head positioned on the burner base such that the burner base and the burner head define a fuel chamber of the outer burner ring between the burner base and the burner head, a plurality of flame ports formed on the burner head, the plurality of flame ports extending from the fuel chamber of the outer burner ring to an outer portion of the outer burner ring, the cap positioned on the burner head such that the burner head and the cap defining a plurality of secondary air channels between the burner head and the cap, an exit of each secondary air channel of the plurality of secondary air channels positioned proximate the outer portion of the outer burner ring, air within the plurality of secondary air channels assisting with cooling the burner head, the cap, or both the burner head and the cap, wherein the burner head is positioned on the burner base such that the burner base and the burner head also define a plurality of retention ports between the burner base and the burner head, the plurality of retention ports positioned adjacent a bottom of the plurality of flame ports or below the plurality of flame ports.

2. The multi-ring gas burner of claim 1, wherein each retention port of the plurality of retention ports is positioned between a respective pair of adjacent retention ports of the plurality of flame ports.

3. The multi-ring gas burner of claim 1, wherein an entrance of each secondary air channel of the plurality of secondary air channels is positioned proximate an inner portion of the outer burner ring.

4. The multi-ring gas burner of claim 3, wherein the burner base defines an opening at the inner portion of the outer burner ring, the opening of the burner base positioned proximate the entrance of each secondary air channel of the plurality of secondary air channels, the opening configured for directing air from below the burner base to the plurality of secondary air channels.

5. The multi-ring gas burner of claim 1, wherein the cap has a ledge that extends over the plurality of flame ports.

6. The multi-ring gas burner of claim 5, wherein the plurality of flame ports are at least partially formed on an outer surface of the burner head, the outer surface of the burner head facing an inner surface of the ledge of the cap, the outer surface of the burner head inclined such that the outer surface of the burner head is substantially parallel to the inner surface of the ledge of the cap.

7. The multi-ring gas burner of claim 6, wherein the secondary air channels of the plurality of secondary air channels slope upwardly from an inner portion of the outer burner ring to the outer portion of the outer burner ring.

8. The multi-ring gas burner of claim 1, wherein the burner base and burner head are formed of cast metal and the cap is formed of stamped metal.

9. The multi-ring gas burner of claim 8, wherein the burner base and burner head are formed of cast aluminum alloy and the cap is formed of stamped steel.

10. A gas burner, comprising:

a burner base;

an annular burner head positioned on the burner base such that the burner base and the burner head define a fuel chamber, a plurality of flame ports formed on the burner head, the plurality of flame ports configured for direction gaseous fuel out the fuel chamber; and an annular cap positioned on the burner head such that the burner head and the cap defining a plurality of secondary air channels between the burner head and the cap, the plurality of secondary air channels positioned above the plurality of flame ports, an exit of each secondary air channel of the plurality of secondary air channels positioned proximate a respective flame port of the plurality of flame ports, air within the plurality of secondary air channels assisting with cooling the burner head, the cap, or both the burner head and the cap, wherein the burner head is positioned on the burner base such that the burner base and the burner head also define a plurality of retention ports between the burner base and the burner head, the plurality of retention ports positioned adjacent a bottom of the plurality of flame ports or below the plurality of flame ports.

11. The gas burner of claim 10, wherein each retention port of the plurality of retention ports is positioned between a respective pair of adjacent retention ports of the plurality of flame ports.

12. The gas burner of claim 10, wherein an entrance of each secondary air channel of the plurality of secondary air channels is positioned proximate an inner portion of the burner head.

13. The gas burner of claim 12, wherein the burner base defines an opening proximate the inner portion of the burner head, the opening of the burner base positioned proximate the entrance of each secondary air channel of the plurality of secondary air channels, the opening configured for directing air from below the burner base to the plurality of secondary air channels.

14. The gas burner of claim 10, wherein the cap has a ledge that extends over the plurality of flame ports.

15. The gas burner of claim 14, wherein the plurality of flame ports are at least partially formed on an outer surface of the burner head, the outer surface of the burner head facing an inner surface of the ledge of the cap, the outer surface of the burner head inclined such that the outer surface of the burner head is substantially parallel to the inner surface of the ledge of the cap.

16. The gas burner of claim 15, wherein the secondary air channels of the plurality of secondary air channels slope upwardly from an inner portion of the burner head ring to an outer portion of the burner head.

17. The gas burner of claim 10, wherein the burner base and burner head are formed of cast metal and the cap is formed of stamped metal.

18. The gas burner of claim 17, wherein the burner base and burner head are formed of cast aluminum alloy and the cap is formed of stamped steel.

* * * * *